US009204721B2

(12) United States Patent
Gasser et al.

(10) Patent No.: US 9,204,721 B2
(45) Date of Patent: Dec. 8, 2015

(54) SPRING-LOADED DRIVE DEVICE FOR A MOVABLE FURNITURE ELEMENT

(71) Applicant: Julius Blum GmbH, Hoechst (AT)

(72) Inventors: Ingo Gasser, Hoechst (AT); Fredi Dubach, Baeretwil (CH)

(73) Assignee: JULIUS BLUM GMBH, Hoechst (AT)

( * ) Notice: Subject to any disclaimer, the term of this patent is extended or adjusted under 35 U.S.C. 154(b) by 0 days.

(21) Appl. No.: 14/457,473

(22) Filed: Aug. 12, 2014

(65) Prior Publication Data

US 2014/0346941 A1 Nov. 27, 2014

Related U.S. Application Data

(63) Continuation of application No. PCT/AT2013/000026, filed on Feb. 13, 2013.

(30) Foreign Application Priority Data

Feb. 15, 2012 (AT) ..... A 189/2012

(51) Int. Cl.
*A47B 88/00* (2006.01)
*A47B 88/04* (2006.01)

(52) U.S. Cl.
CPC ..... *A47B 88/04* (2013.01); *A47B 88/047* (2013.01)

(58) Field of Classification Search
CPC ..... A47B 88/00; A47B 88/04; A47B 88/047; A47B 88/0477; A47B 88/0481; A47B 2088/047
See application file for complete search history.

(56) References Cited

U.S. PATENT DOCUMENTS

| | | | | |
|---|---|---|---|---|
| 7,244,005 | B1 * | 7/2007 | Lu | 312/333 |
| 2003/0228918 | A1 | 12/2003 | Doornbos | |
| 2007/0145867 | A1 * | 6/2007 | Gasser | 312/223.6 |
| 2008/0191592 | A1 * | 8/2008 | Dubach | 312/319.1 |
| 2009/0140621 | A1 * | 6/2009 | Yang | 312/319.1 |
| 2010/0038467 | A1 | 2/2010 | Gassner | |
| 2011/0041284 | A1 * | 2/2011 | Kimura et al. | 16/49 |
| 2011/0175508 | A1 * | 7/2011 | Rechberg et al. | 312/334.8 |
| 2011/0225768 | A1 | 9/2011 | Haemmerle | |
| 2013/0133157 | A1 * | 5/2013 | Kimura | 16/49 |
| 2014/0189979 | A1 * | 7/2014 | Rioja Calvo | 16/80 |
| 2015/0091427 | A1 * | 4/2015 | Haemmerle et al. | 312/333 |

FOREIGN PATENT DOCUMENTS

| | | |
|---|---|---|
| CN | 101952533 | 1/2011 |
| DE | 198 25 324 | 12/1999 |
| DE | 20 2006 006 182 | 8/2007 |
| DE | 20 2009 005 121 | 12/2010 |
| EP | 1 371 873 | 12/2003 |
| JP | 2007-252491 | 10/2007 |
| WO | 2006/017865 | 2/2006 |
| WO | 2008/128257 | 10/2008 |
| WO | 2009/152537 | 12/2009 |
| WO | 2010/075595 | 7/2010 |

OTHER PUBLICATIONS

International Search Report (ISR) issued Apr. 26, 2013 in International (PCT) Application No. PCT/AT2013/000026.
Austrian Patent Office Search Report (ASR) issued Nov. 5, 2012 in Austrian Patent Application No. A 189/2012.

* cited by examiner

*Primary Examiner* — Daniel Rohrhoff
(74) *Attorney, Agent, or Firm* — Wenderoth, Lind & Ponack, L.L.P.

(57) ABSTRACT

Spring-loaded drive device for a movable furniture element, especially a drawer, comprising a mechanical deactivation device with which the drive device can be reversibly deactivated.

20 Claims, 15 Drawing Sheets

FIG. 3
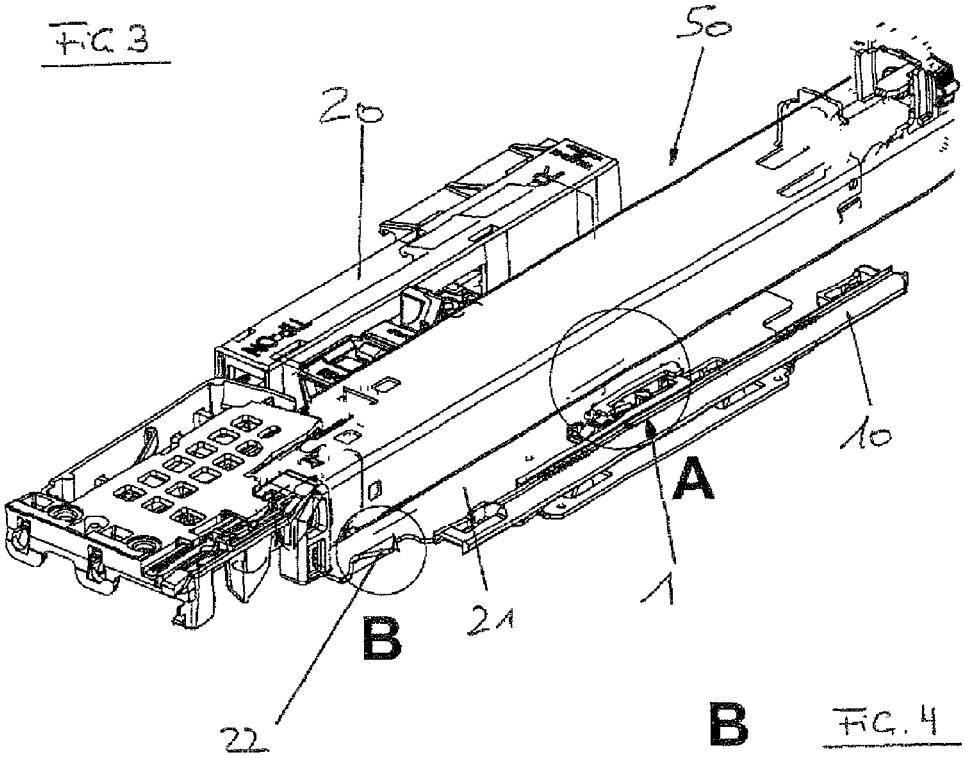
B FIG. 4
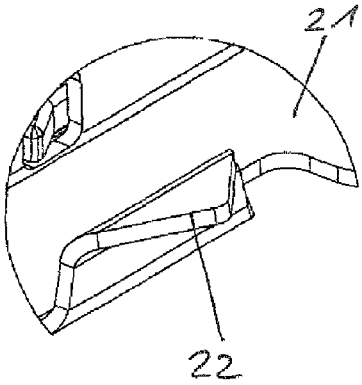
A FIG. 5
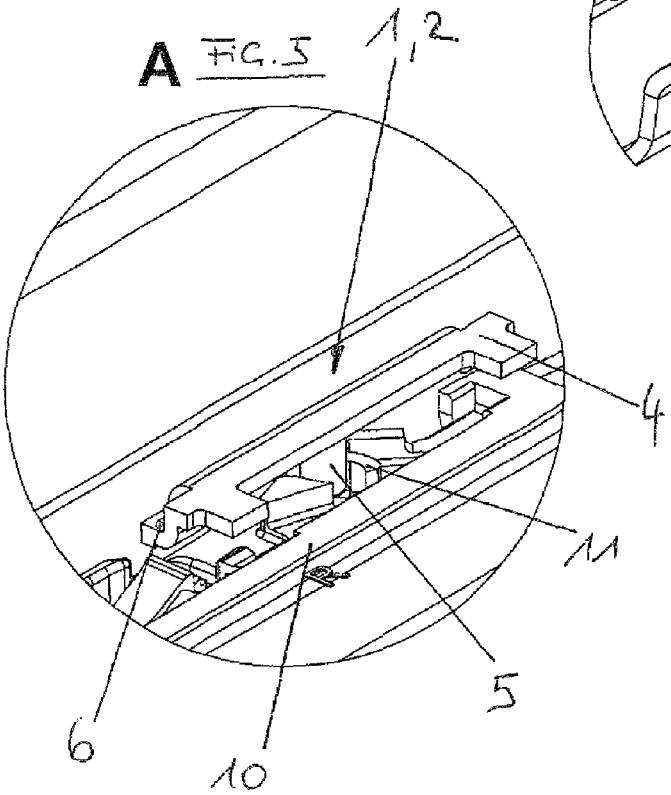

Fig. 6
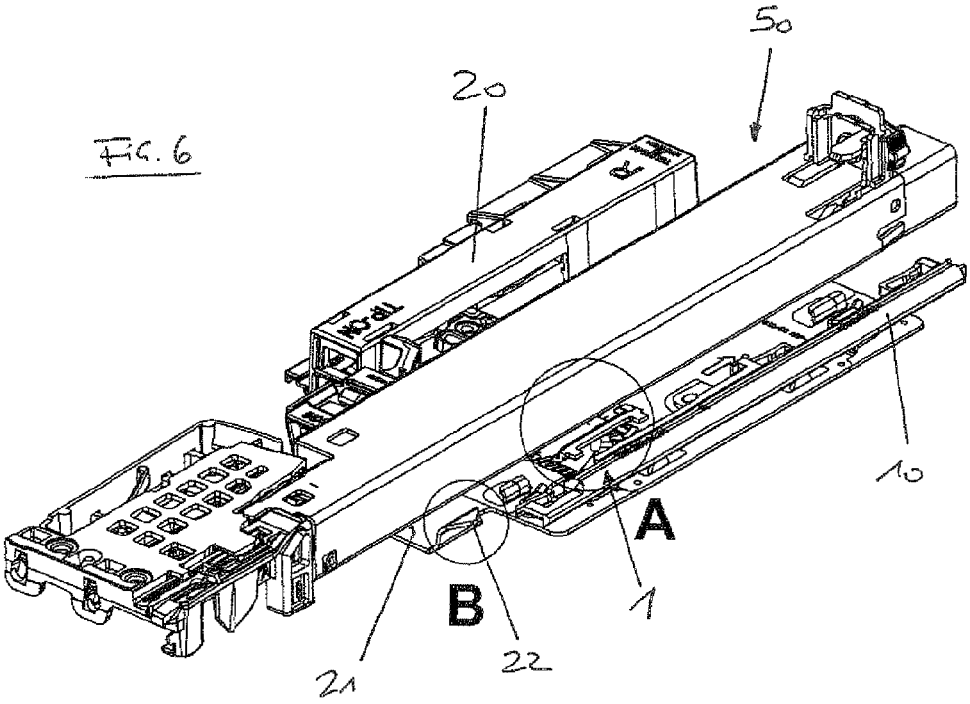
B Fig. 7
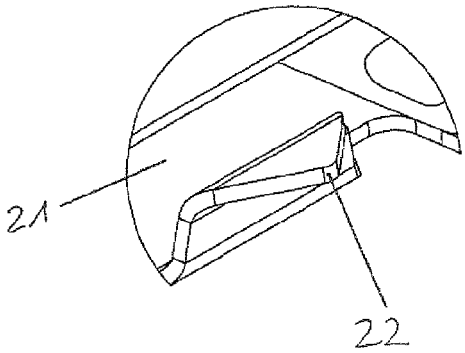
A Fig. 8
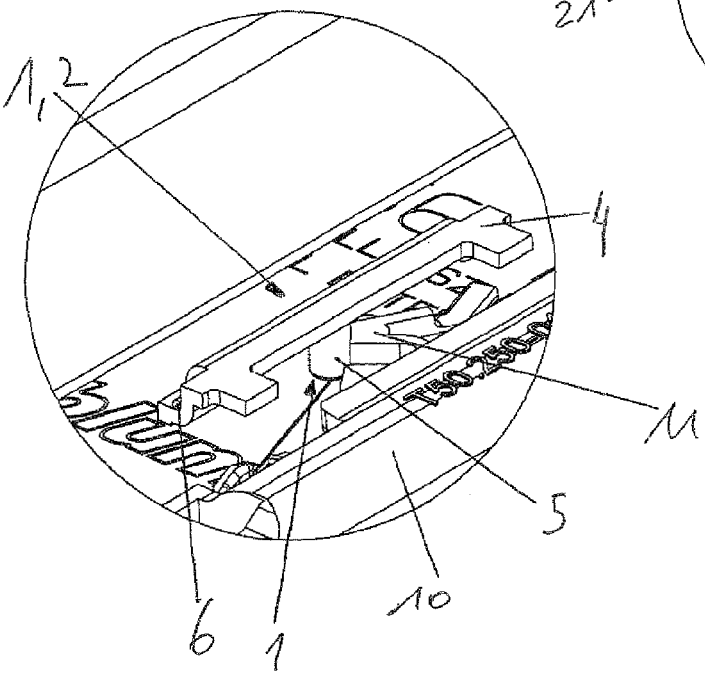

FIG. 9
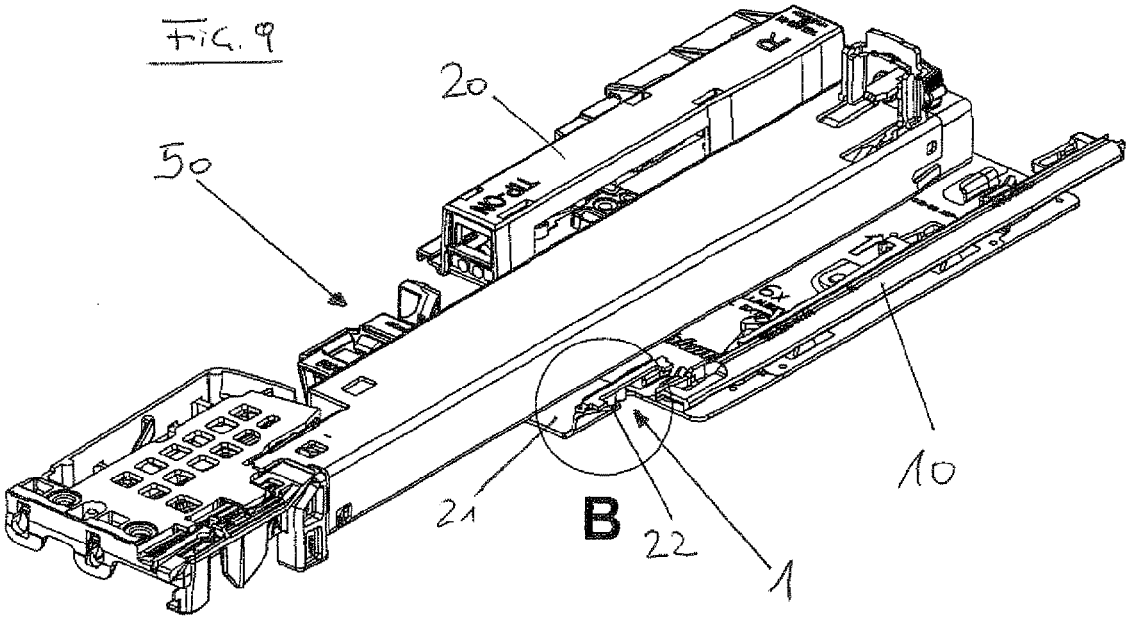
B FIG. 10
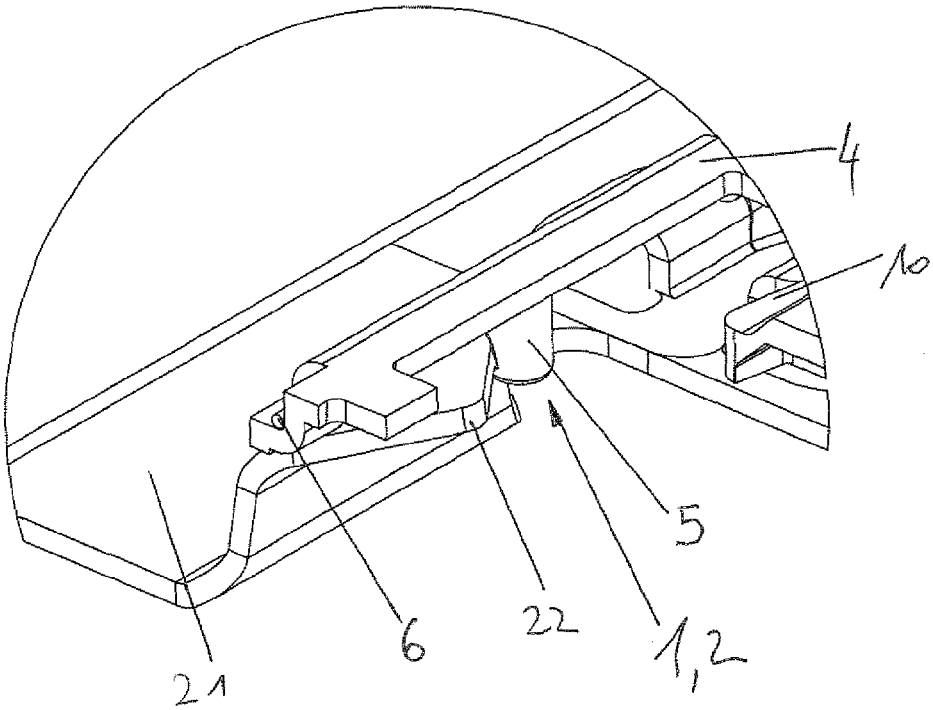

B

FIG. 13
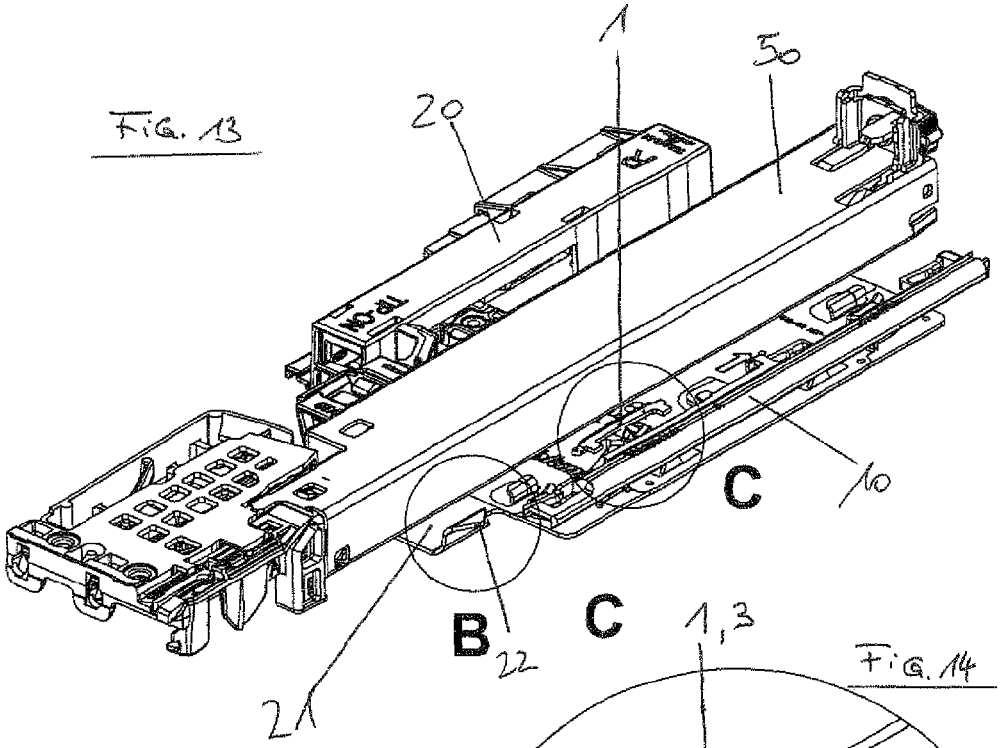
FIG. 14
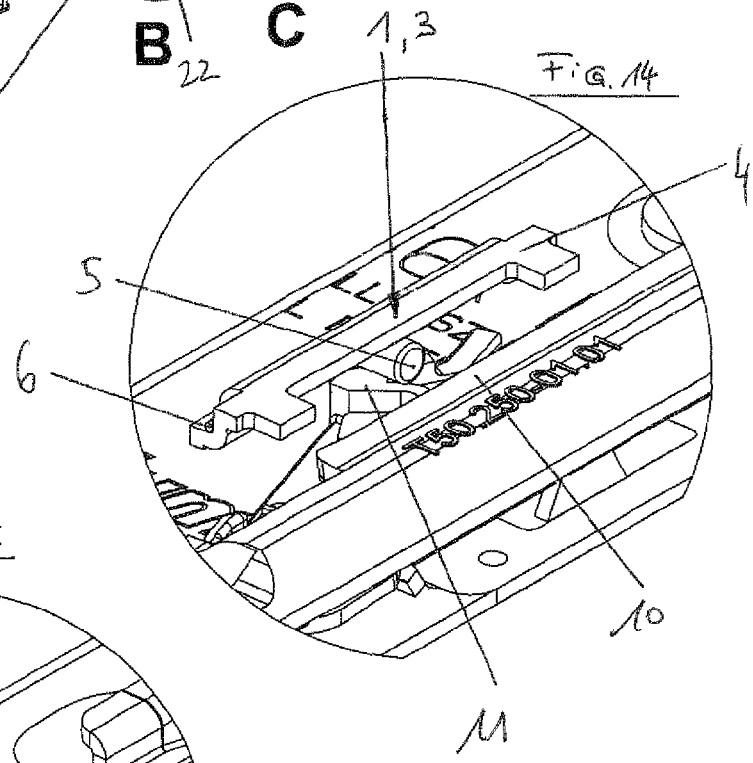
B FIG. 15
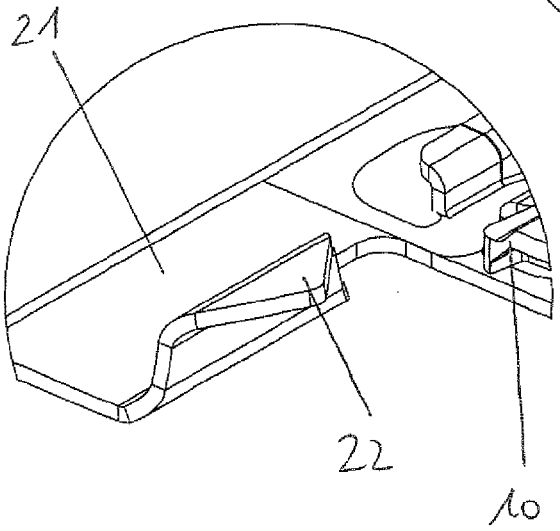

FIG. 26
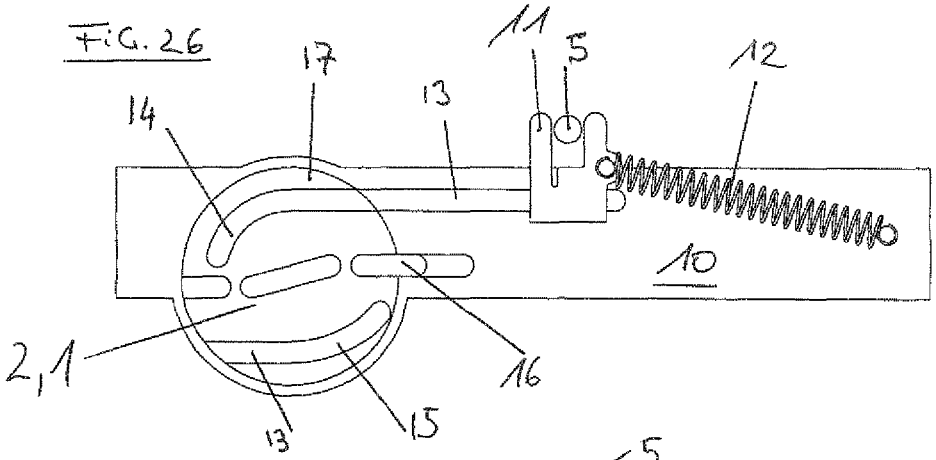
FIG. 27
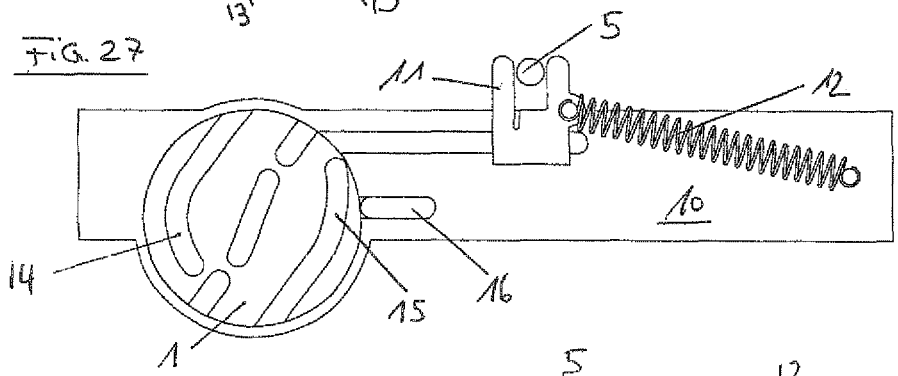
FIG. 28
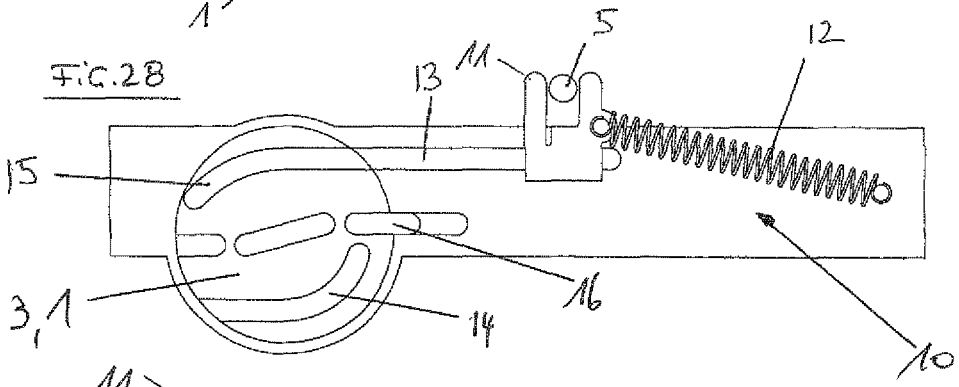
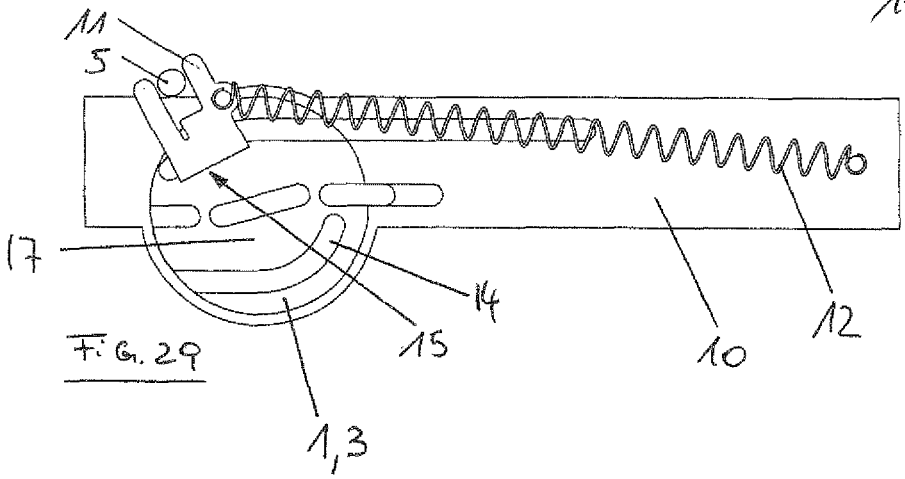
FIG. 29

SPRING-LOADED DRIVE DEVICE FOR A MOVABLE FURNITURE ELEMENT

BACKGROUND OF THE INVENTION

1. Field of the Invention

The invention concerns a spring-loaded drive device for a moveable furniture part, in particular a drawer.

The invention further concerns an article of furniture having a drive device for a moveable furniture part—in particular a drawer—according to at least one of the described embodiments.

2. Description of Related Art

Spring-loaded drive devices for moveable furniture parts already belong to the state of the art. They are often in the form of a retraction device in order to pull the moveable furniture part to or in the furniture carcass. A further configuration of a spring-loaded drive device involves ejection devices which move the moveable furniture part out of the furniture carcass or away from the furniture carcass to make operation of the article of furniture more pleasant.

SUMMARY OF THE INVENTION

The object of the invention is to provide an improved spring-loaded drive device for a moveable furniture part and an improved article of furniture having such a drive device.

That object is attained with a drive device wherein there is provided a mechanical deactivation device with which the drive device can be reversibly deactivated and an article of furniture having the mechanical deactivation device embodied in the drive device.

The provision of a mechanical deactivation device with which the drive device can be reversibly deactivated means that the drive device can be deactivated when not in use and does not have to be especially removed for that purpose. The configuration in terms of reversibility means that the drive device can also be re-activated at any time in order to drive the moveable furniture part again. Thus neither removal nor re-installation is necessary to achieve that functionality for a drive device.

The drive device is thus disabled only at times. The function thereof is retained but is shut down whereby there is no need to uninstall the drive device if there is a wish not to use it for a certain time.

In this respect it should be noted that this does not involve electrically switching something on or off, but it involves deactivating a unit mechanically and not with electrical means.

Further advantageous embodiments of the invention are recited in the appendant claims.

It has been found to be particularly advantageous if the deactivation device is adapted to be switchable over between two mechanical switching positions wherein a first switching position activates the drive device and a second switching position deactivates the drive device. The provision of switching positions makes it possible to achieve comfortable activation and deactivation of the drive device.

In a preferred embodiment it can be provided that switching-over is mechanically effected automatically from the first switching position in which the drive device is activated into the second switching position in which the drive device is deactivated. Automatic mechanical switching-over from the first switching position into the second switching position means that there is no need for manual actuation, which thus saves on time and thus costs.

An article of furniture having a drive device for a movable furniture part—in particularly a drawer—is provided, according to at least one of the described embodiments.

A particularly advantageous structural variant provides that automatic mechanical switching-over is effected by the second drive device during the first-time movement of the moveable furniture part—preferably the drawer—after installation of the second drive device has been effected. The fact that automatic switching-over is effected during the first-time movement of the moveable furniture part means that there is no need for a dedicated working step for implementing the switching-over process as that can take place simultaneously in usual use of the moveable furniture part.

BRIEF DESCRIPTION OF THE DRAWINGS

Further details and advantages of the present invention are described more fully hereinafter by means of the specific description with reference to the embodiments by way of example illustrated in the drawing in which:

FIG. 3 shows a perspective view of a rail extension guide with two drive devices, FIG. 4 shows a detail view of FIG. 3, FIG. 5 shows a further detail view of FIG. 3, FIG. 6 shows a further perspective view of a rail extension guide with two drive devices, FIG. 7 shows a detail view of FIG. 6, FIG. 8 shows a detail view of FIG. 6, FIG. 9 shows a further perspective view of a rail extension guide with two drive devices, FIG. 10 shows a detail view of FIG. 9, FIG. 13 shows a further perspective view of a rail extension guide with two drive devices, FIG. 14 shows a detail view of FIG. 13, FIG. 15 shows a detail view of FIG. 13.

DETAILED DESCRIPTION OF THE INVENTION

Figure 1:
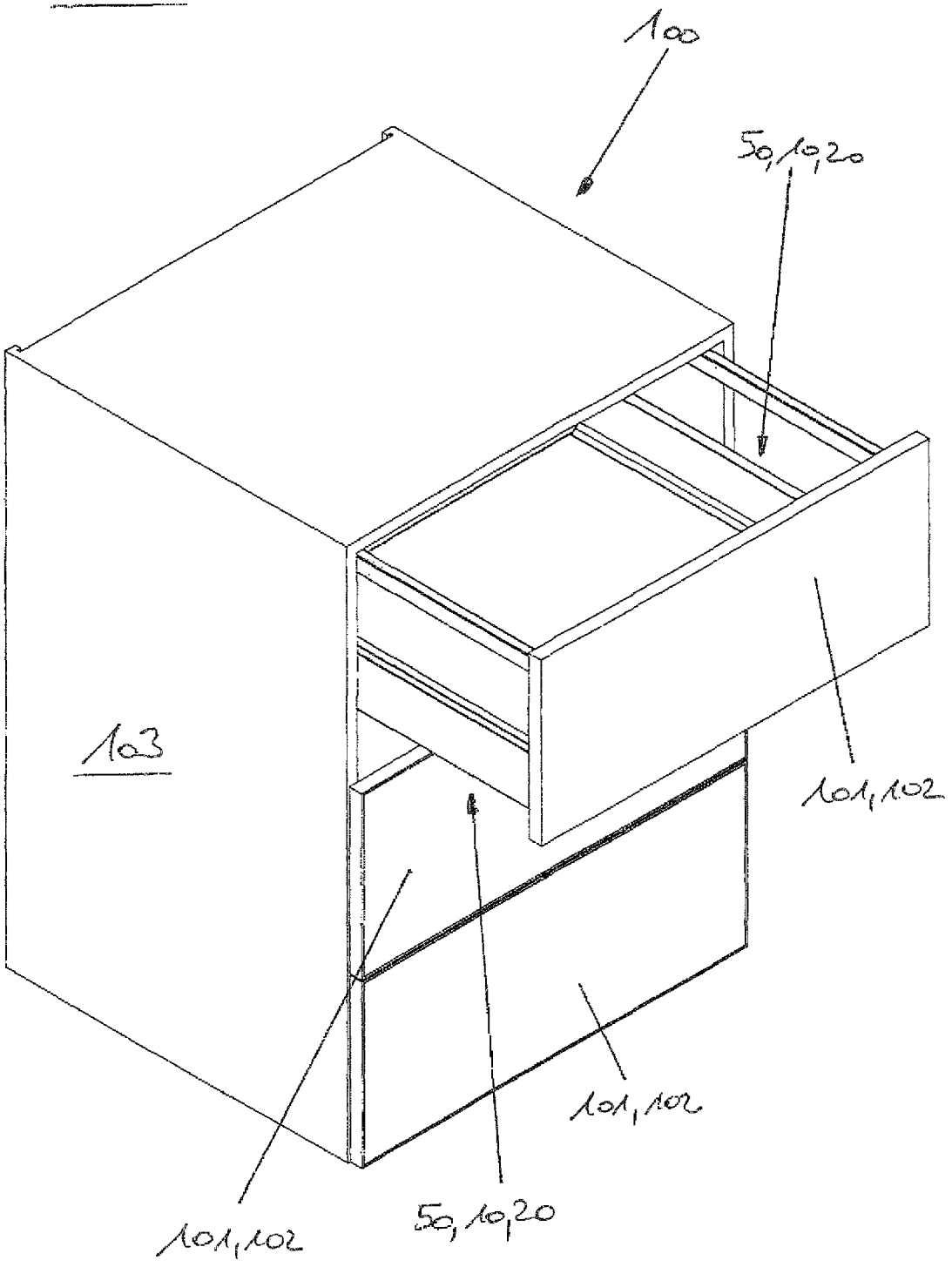
FIG. 1 shows a perspective view of an article of furniture with three drawers.

FIG. 1 shows a perspective view of an article of furniture 100. The article of furniture 100 has a furniture carcass 103 and arranged therein three moveable furniture parts 101 which in this embodiment are in the form of drawers 102. So that the drawers 102 can be pulled out of the furniture carcass 103 and pushed in again each drawer has two respective rail extension guides 50 (not visible). Provided on the rail extension guides 50 for each drawer there is at least one spring-loaded drive device with which the drawer 102 can be automatically pushed out or pulled in.

If now retro-fitting of a second drive device 20 is wanted then that can be subsequently installed in the article of furniture 100. Such a second drive device 20 preferably has an ejection device and a retraction device. So that the two drive devices 10 and 20 do not influence each other it would be necessary in itself to remove the original drive device 10. As that is not wanted because of the high degree of complication and effort the drive device 10 has the deactivation device 1 (not shown here) with which the drive device 10 can be reversibly deactivated.

Figure 2:
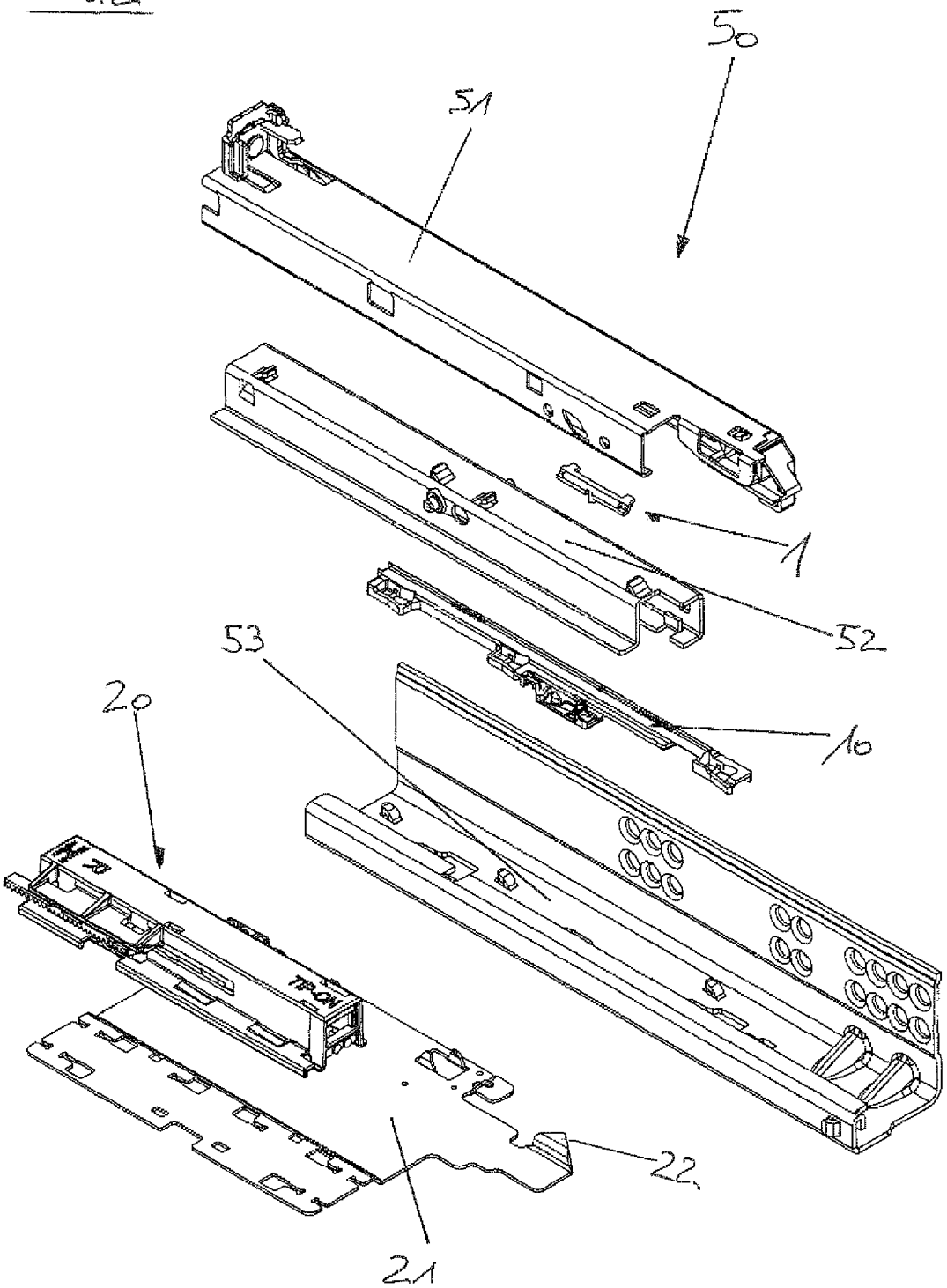
FIG. 2 shows a perspective exploded view of a rail extension guide with two drive devices.

FIG. 2 shows a perspective exploded view of the rail extension guide 50. The rail extension guide 50 has inter alia the drawer rail 51, the central rail 52 and the carcass rail 53 with which the rail extension guide 50 is fixed to the furniture carcass. In that case provided on the carcass rail 53 is the drive device 10 with which the drawer can be pulled in, in this preferred embodiment.

The second drive device 20 is subsequently fitted in order to equip the rail extension guide 50 both with a drive device for ejection of the drawer and also with a drive device for retraction of the drawer. For that purpose it is necessary to deactivate the first drive device 10.

Provided on the second drive device 20 on the base plate 21 thereof is a nose 22 which can engage into the first drive device 10 and with its nose 22 as a triggering device can actuate the deactivation device 1.

FIG. 3 shows a perspective view of the rail extension guide 50 with the first drive device 10 and with the second drive device 20 already fitted in position.

FIG. 4 shows the nose 22 on the base plate 21 of the second drive device 20.

FIG. 5 shows the deactivation device 1, with its switchable coupling element 5 and its holder 4. In the situation illustrated here the deactivation device 1 has not yet been actuated as the coupling element 5 is still in the entrainment member 11 of the drive device 10 and thus there is a mechanical connection between the coupling element 5 and the drive device 10.

FIGS. 6 through 8 now show how the nose 22 of the second drive device 20 approaches the deactivation device 1. That situation occurs when the drawer is pulled out of the furniture carcass 103 for the first time after installation of the second drive device 20.

FIGS. 9 and 10 now show how the drawer has been pulled out on the first occasion since installation of the additional drive device 20, to such an extent that the nose 22 of the second drive device 20 encounters the pivotable coupling element 5 of the deactivation device 1, but in this situation shown here in FIG. 10 it has not yet switched over and the deactivation device 1 is therefore still in its first switching position 2 in which the drive device 10 is still active.

Figure 11:
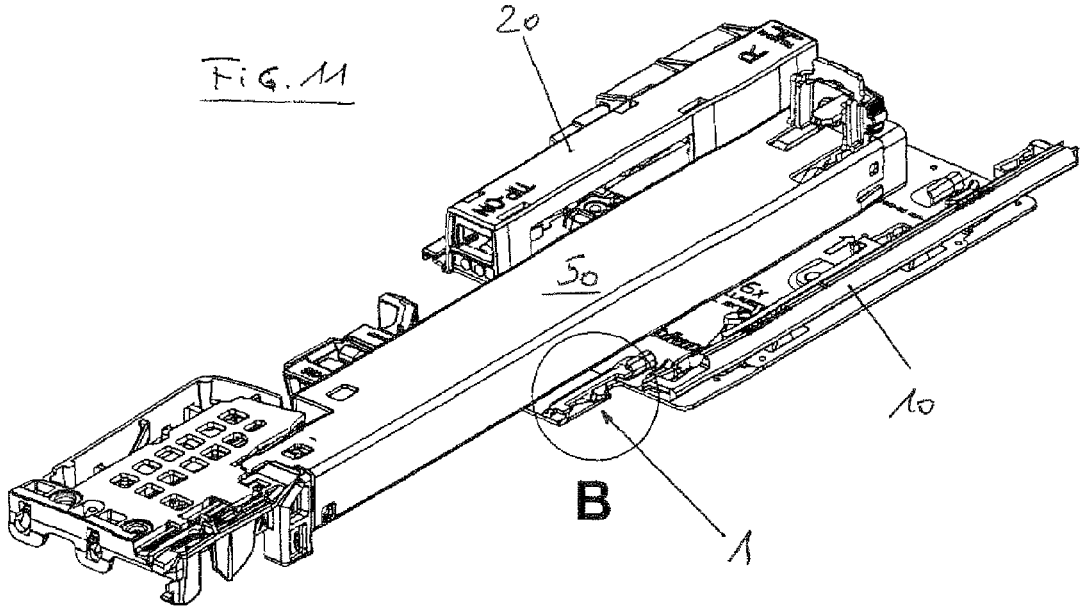
FIG. 11 shows a further perspective view of a rail extension guide with two drive devices.
Figure 12:
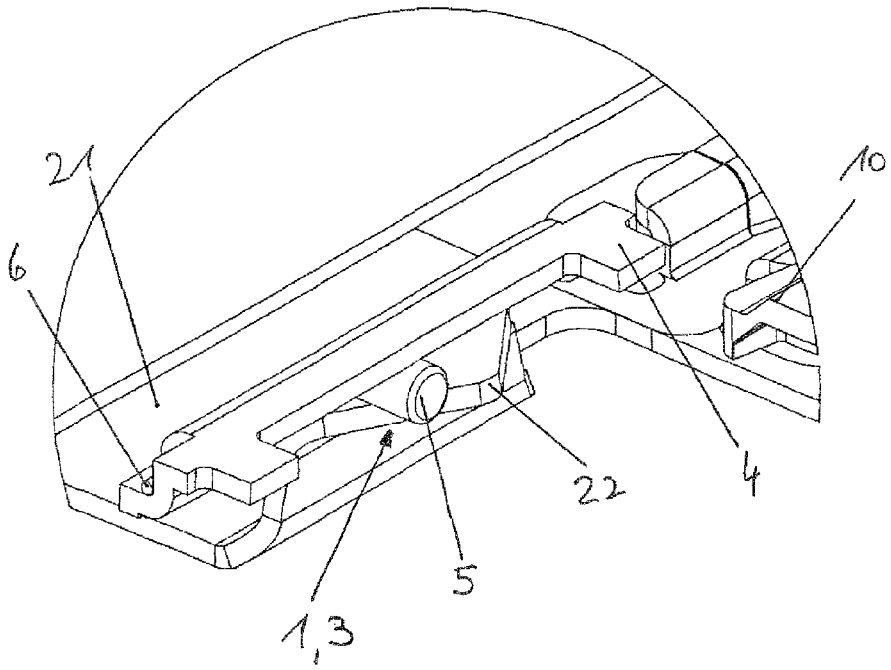
FIG. 12 shows a detail view of FIG. 11.

If now the rail extension guide 50 is pulled out a little further—as is shown in FIGS. 11 and 12—then the nose 22 of the second drive device 20 causes the switchable coupling element 5 to pivot through 90°, whereupon the coupling element 5 can no longer correspond to the entrainment member 11 (not shown here) of the first drive device 10—as can be clearly seen from FIG. 14. The deactivation device 1 is therefore now in its second switching position 3 in which the drive device 10 has been deactivated.

FIGS. 13 through 15 show the situation in which the drawer or the rail extension guide 50 has been pulled out to such an extent that the deactivation device 1 was switched and thus the first drive device 10 was reversibly deactivated.

Figure 16:
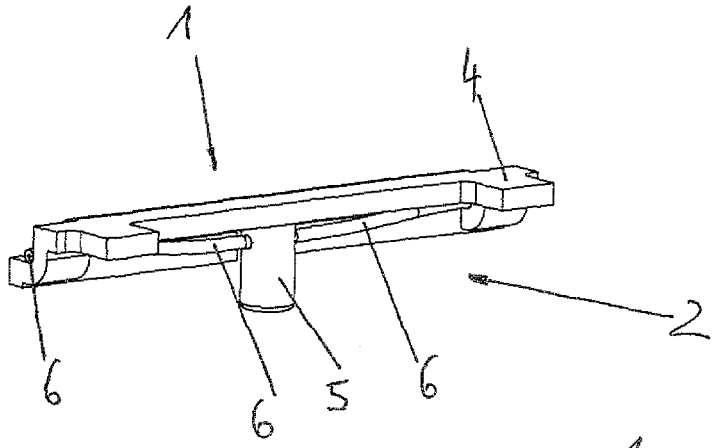
FIG. 16 shows a perspective view of the deactivation device in the active position.

FIG. 16 shows a perspective view of the deactivation device 1. In this case the deactivation device 1 has the switchable coupling element 5, its holder 4 and the spring 6 which extends through a bore 7 in the coupling element 5. FIG. 16 shows that the deactivation device 1 has not yet been actuated and the deactivation device 1 is therefore still in its first switching position 2 in which the drive device 10 is still active.

Figure 17:
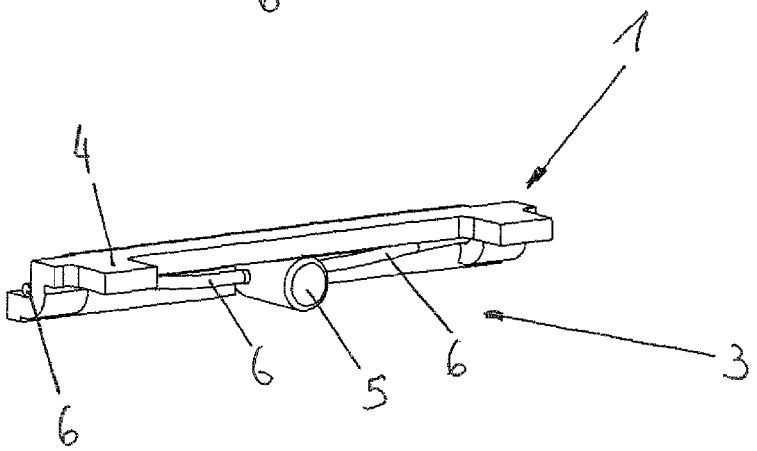
FIG. 17 shows a perspective view of the deactivation device in the deactivated position.

In contrast to FIG. 17 where the deactivation device 1 has been actuated by the coupling element 5 having been pivoted and thus by the coupling element 5 no longer being able to come into engagement with the entrainment member 11 (not shown here) of the drive device 10. The deactivation device 1 is therefore now in its second switching position 3 in which the drive device 10 has been deactivated.

Figure 18:
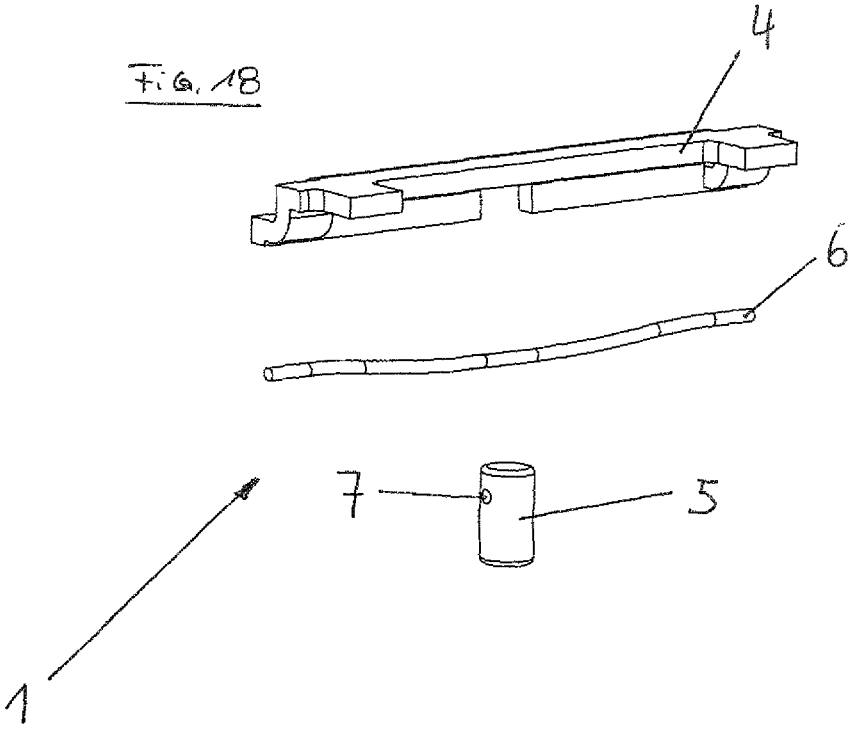
FIG. 18 shows a perspective exploded view of the deactivation device.

FIG. 18 shows a perspective exploded view of the deactivation device 1. In this case the spring 6 serves to provide that the coupling element 5 remains in the desired switched position and cannot automatically switch over again.

Figure 19:
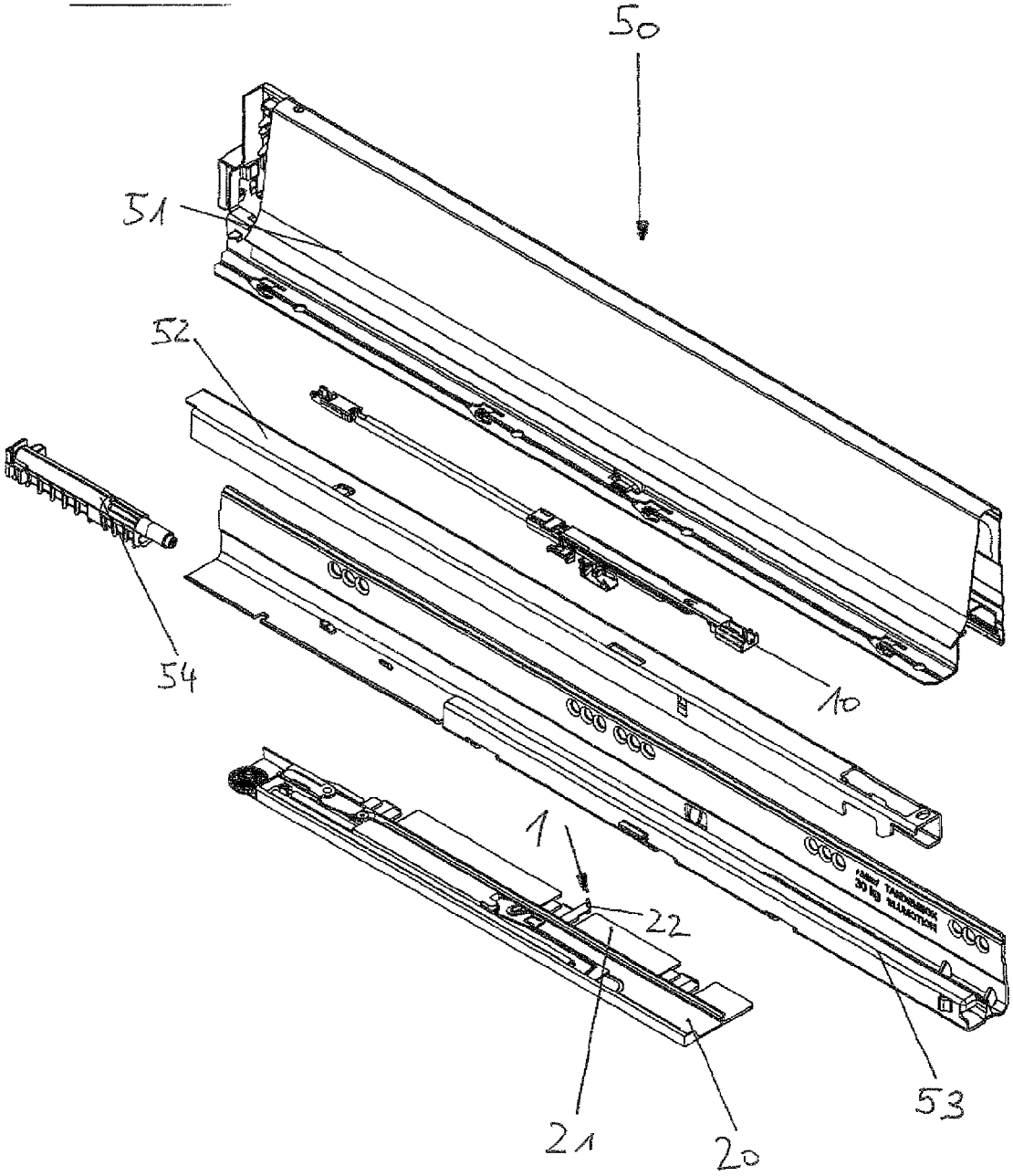
FIG. 19 shows a perspective exploded view of a rail extension guide with two drive devices.

FIG. 19 shows a perspective exploded view of a further embodiment. This embodiment also has a rail extension guide 50 and the associated rails—the drawer rail 51, the central rail 52 and the carcass rail 53. The drive device 10 is also again provided on the carcass rail 53.

The second drive device 20 can be subsequently fitted and has the base plate 21 on which the deactivation device 1 is provided.

Figures 20, 21, 22:
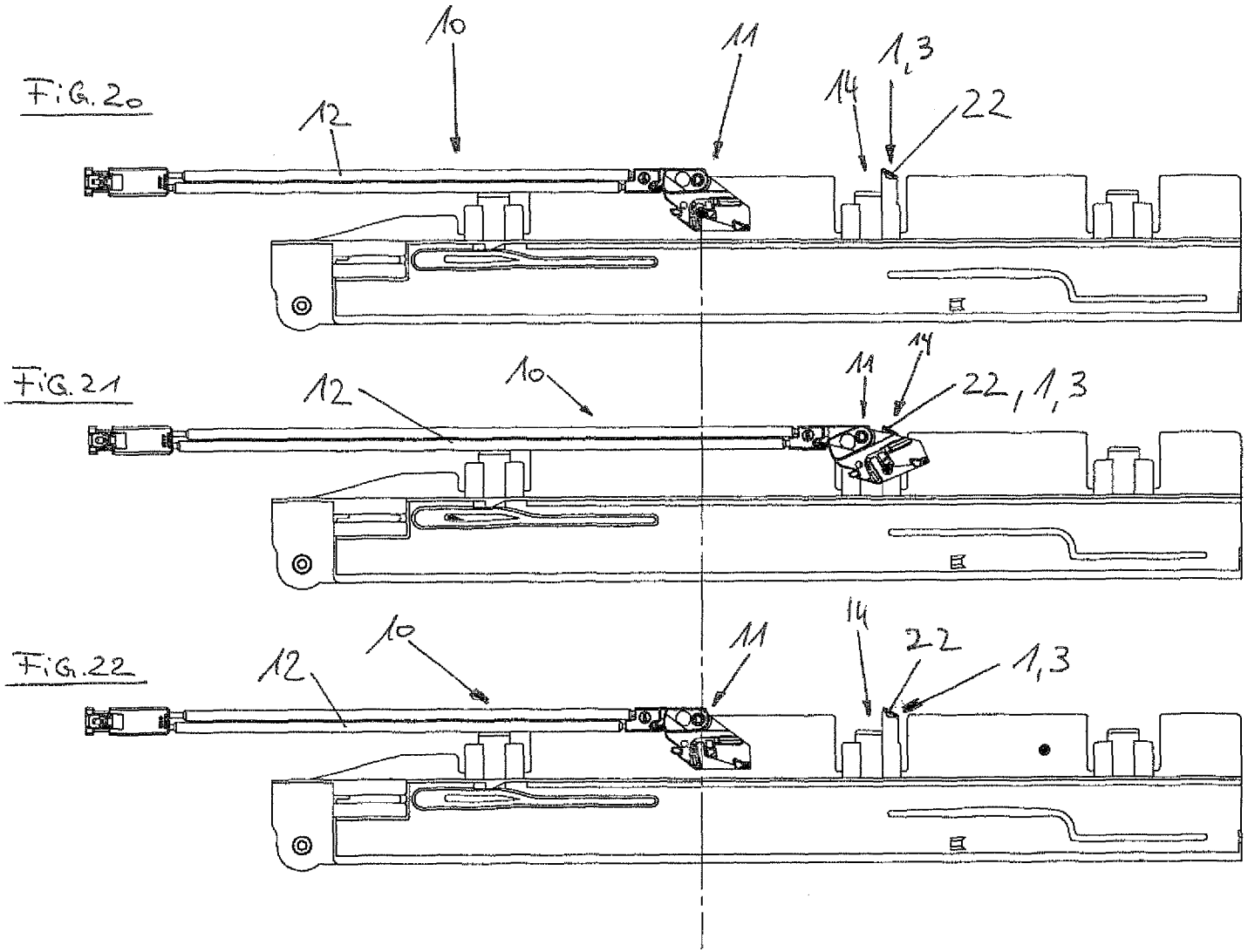
FIGS. 20 through 22 show plan views of a rail extension device with a deactivation device in various positions of the drive device.
Figure 23:
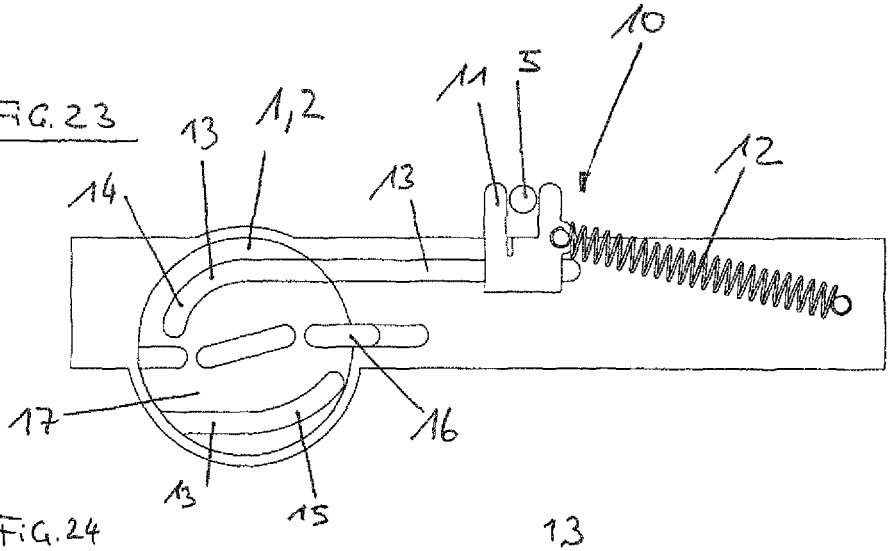
FIGS. 23 and 24 show diagrammatic views of a drive device in various positions.
Figure 24:
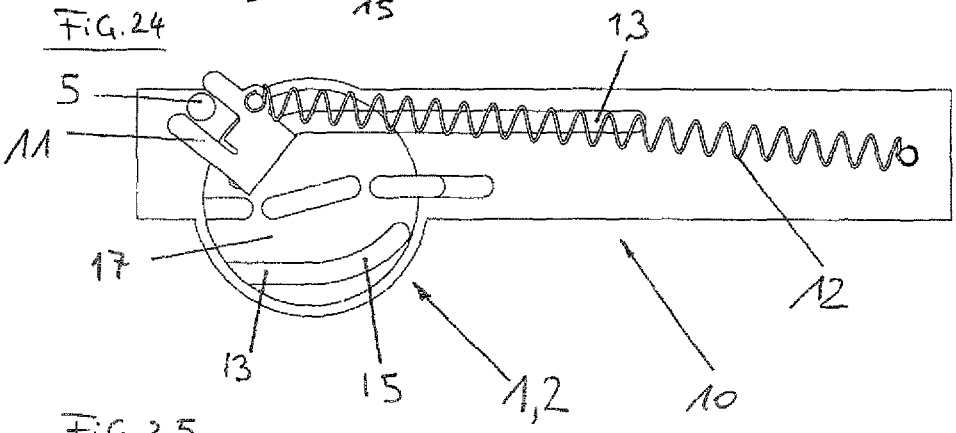

FIG. 20 shows the drive device 10 which has the entrainment member 11 and the springs 12, with which the drive device 10 is driven.

So that the drive device 10 can drive a coupling element (not shown) it moves—as shown in FIG. 21—into its readiness position 14 in which the entrainment member 11 is waiting for the coupling element. As however the deactivation device 1—in the form of the nose 22—is now at the readiness position 14 the entrainment member 11 cannot go to its readiness position 14 in order to wait for the coupling element (the deactivation device 1 is therefore in its second switching position 3 in which the drive device 10 has been deactivated).

Whereupon the entrainment member 11 is retracted again by the springs 12 of the drive device 10 without the coupling element being entrained in that case. Accordingly the drive device 10 was deactivated by the deactivation device 1. If there is a wish to re-activate the drive device 10 only the nose 22 of the deactivation device 1 has to be removed, whereupon the drive device 10 can exert its normal function again.

A further embodiment of a deactivation device 1 for a drive device 10 is shown in FIGS. 23 through 31.

In this arrangement the drive device 10 again has the spring 12 and the entrainment member 11 which is spring-loaded by the spring 12 and which can apply force to the coupling element 5. The entrainment member 11 is guided in a guide track 13. When the guide plate 17 is in its normal working position then the entrainment member 11 in its readiness position can wait for the coupling element 5 to arrive as that readiness position 14 is in the form of a self-locking, arrestable position, and that can be achieved by suitable dimensioning of the radius out of the guide track 13 (friction). The deactivation device 1 is therefore still in its first switching position 2 in which the drive device 10 is still active (FIGS. 23 through 26).

Reversible deactivation of the drive device 10:

The guide track 13 is altered by rotation of the guide plate 17 (see FIGS. 27 and 28), insofar as this entails an exchange of the readiness position 14 which now has a larger radius than the readiness position in the working position of the drive device 10

(FIG. 28). When now the entrainment member 11 (FIG. 29) passes into that new readiness position 15—which is no longer self-locking—then the entrainment member 11 does not remain in that position to wait for the coupling element 5 but is automatically retracted again by the spring force of the spring 12, and the drive device 10 is thus deactivated.

Rotation of the guide plate 17 is effected by releasing the clamping lever 16 (FIG. 27) and then rotating the guide plate 17 and re-closing the clamping lever 16 (FIG. 28). The deactivation device 1 is therefore now in its second switching position 3 in which the drive device 10 has been deactivated (FIGS. 28 through 31).

If there is a wish to re-activate the drive device 10 then the clamping lever 16 only has to be released, to again rotate the guide plate 17 in order to replace the non-locking position 15 by the self-locking readiness position 14, which can be achieved by a 180° rotation of the guide plate 17. The clamping lever 16 is then closed again.

Figure 25:
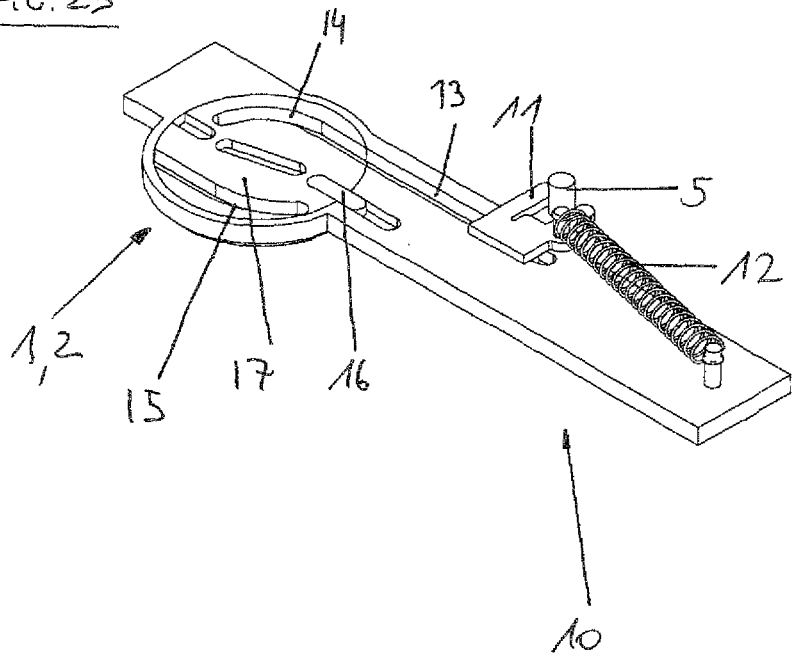
FIG. 25 shows a perspective view of the drive device of FIGS. 23 and 24, FIGS. 26 through 29 show plan views of diagrammatic illustrations of a spring-loaded drive device and the deactivation device thereof.
Figure 30:
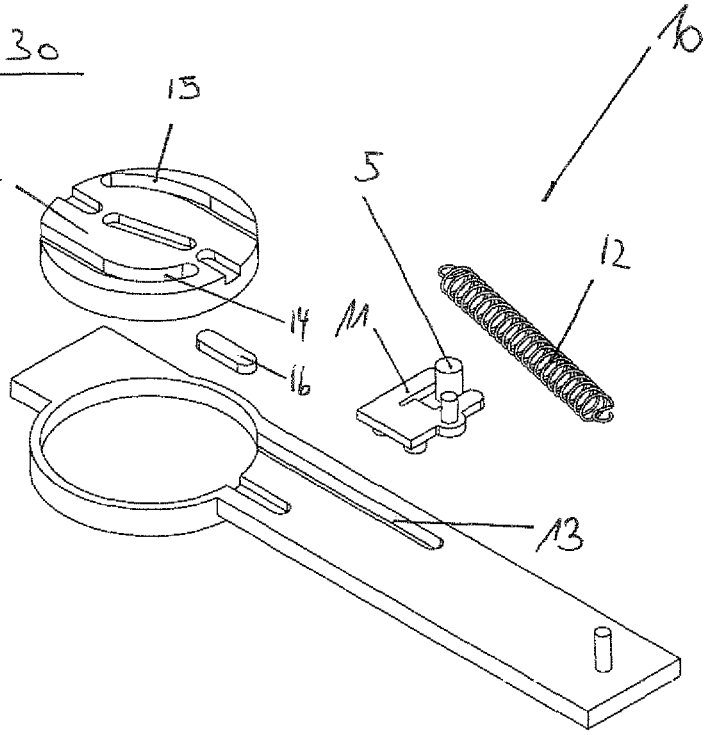
FIG. 30 shows a perspective exploded view of the spring-loaded drive device of FIG. 28.
Figure 31:
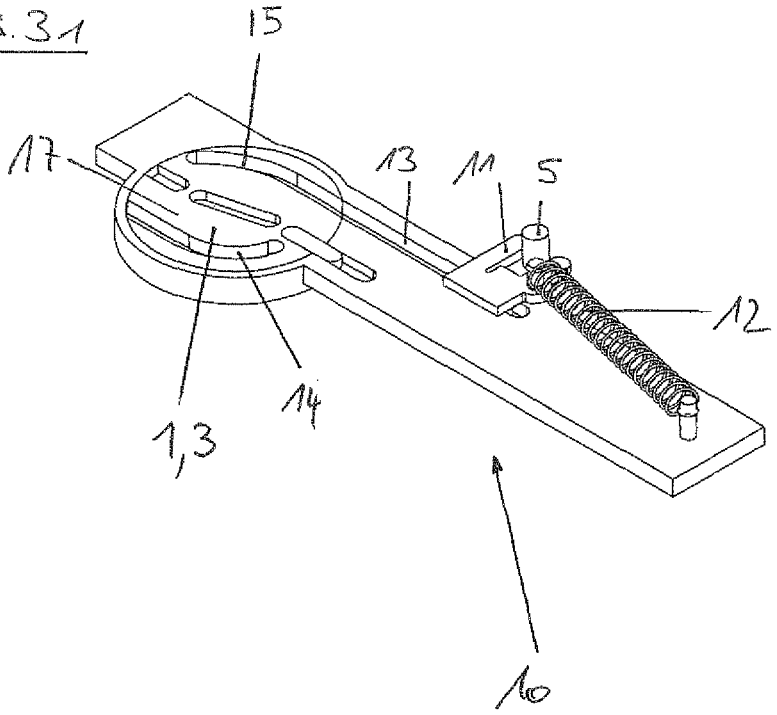
FIG. 31 shows a perspective view of the drive device of FIG. 28, FIG. 32 through 34 show diagrammatic views of a variant of a deactivation device of a spring-loaded drive device.

FIG. 25 shows a drive device 10 in the activated condition while FIG. 31 shows the drive device 10 in the deactivated condition.

Figure 32:
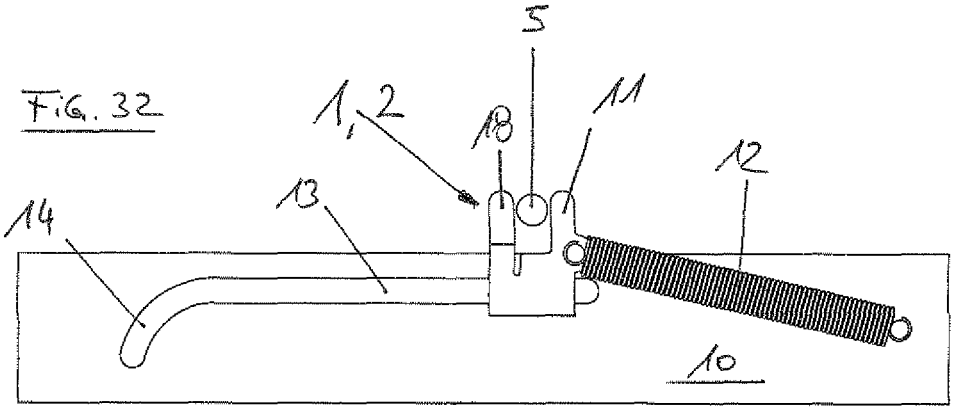
Figure 33:
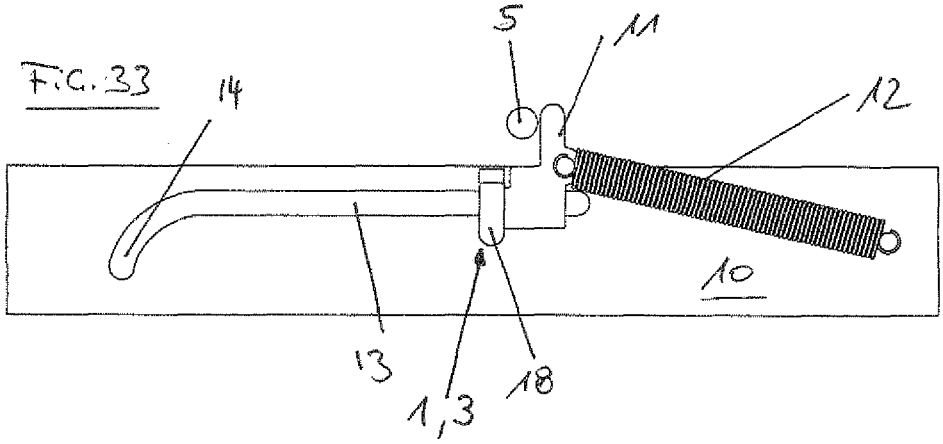
Figure 34:
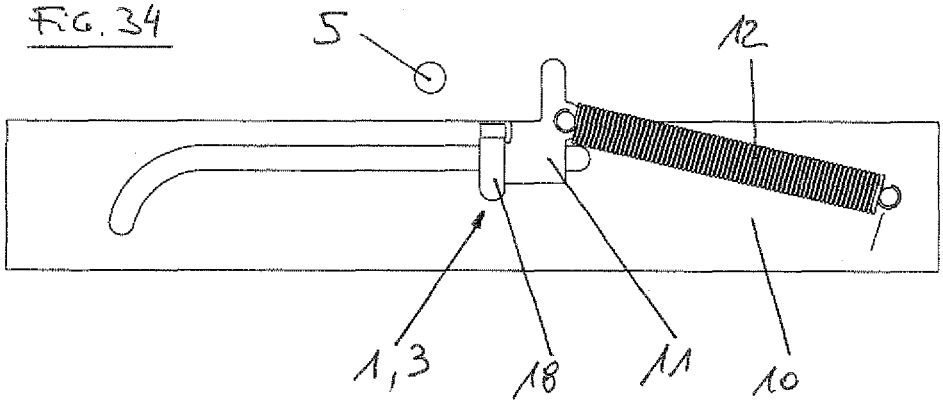

A further embodiment of a deactivatable drive device 10 is shown in FIGS. 32 through 34.

In that case the entrainment member 11 of the drive device 10 is equipped with a pivotable entrainment nose 18. In FIG. 32 the deactivation device 1 is still in its first switching position 2 in which the drive device 10 is still active. If the pivotable entrainment nose 18 is tilted out of its normal working position (FIG. 33) then the entrainment member 11 can no longer entrain the coupling element 5 (see FIG. 34). Thus the drive device 10 is deactivated by the deactivation device 1 and is in the second switching position 3. To re-activate the drive device 10 it is only necessary for the pivotable entrainment nose 18 to be pivoted into its normal working position (FIG. 32), whereupon the drive device can perform its normal function again.

A further embodiment of a deactivatable drive device 10 is shown in FIGS. 35 through 39.

In this embodiment, the entrainment member is not deactivated as in FIGS. 32 through 34, nor is the guide track deactivated as in FIGS. 23 through 31, nor is the readiness position deactivated as in FIGS. 19 through 22, nor is the coupling element 5 deactivated as in FIGS. 2 through 19, but here the base 33 of the spring 12 of the drive device 10 is now deactivated by the base 33 of the drive device 10 not being of a rigid configuration but being capable of moving in a guide 30 insofar as having been pivoted by way of the deactivation device 1—which has the pivotable lock element 31.

Figure 35:
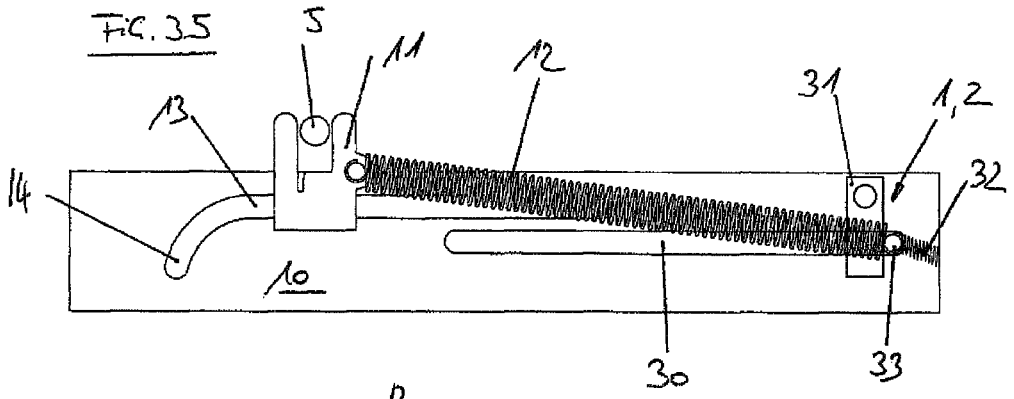
FIGS. 35 through 39 show diagrammatic views of a further deactivation device for a spring-loaded drive device.
Figure 36:
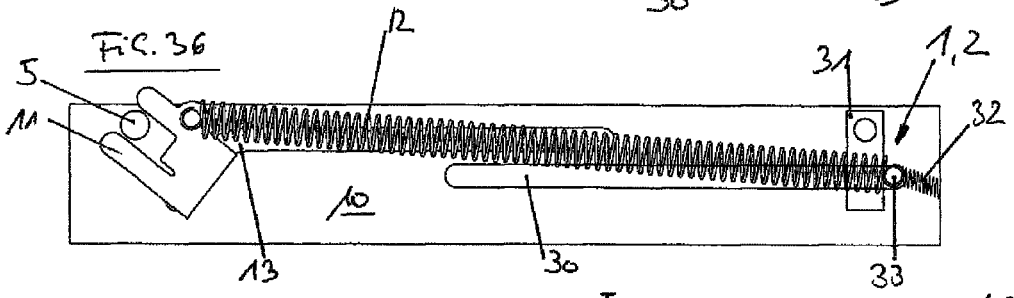
Figure 37:
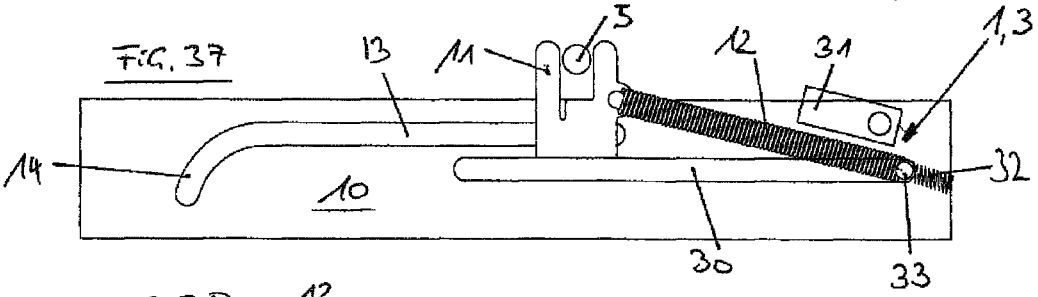

The normal functioning of the drive device 10 is shown in FIGS. 35 and 36, if now the pivotable lock element 31 is pivoted then the base 33 can move in the guide 30 (FIG. 38) whereupon the entrainment member 11 is no longer sufficiently spring-loaded by the spring 12 and thus can no longer displace the coupling element 5.

So that the entrainment member 11 can in turn move in a jam-free fashion on its guide track 13 the base 33 is spring-loaded by way of the return spring 32, whereby the entrainment member 11 and the base 33—without the coupling element 5—can move into their starting position. The drive device 10 is thus deactivated.

If there is a wish to activate the drive device 10 again then only the pivotable lock element 31 is to be used, whereupon the base 33 is fixed in the guide 30 again and the drive device 10 can again perform the normal function (FIGS. 35 and 36).

FIGS. 2 through 39 show some variants as to how a drive device 10 can be reversibly deactivated. It is self-evident that there are also many other possible ways of reversibly deactivating a drive device. Thus it could also be envisaged that the guide track of the entrainment member is pivoted, whereupon the entrainment member can no longer move, or the spring of the drive device or the entrainment member thereof is removed and—if for example there should be a wish to bring the drive device back into operation again—those components are re-fitted. Naturally these are not desired configurations as they would be extremely complicated and expensive and thus are not to be employed in practice.

The preferred embodiments are therefore those in which deactivation and activation is effected automatically, more specifically quite simply by installing the second drive device or by removal of the second drive device, whereupon the first drive device is active again (embodiments of FIGS. 12 through 18 and FIGS. 19 through 22).

The fact that a mechanical deactivation device 1 is provided for the spring-loaded drive device 10, with which the drive device 10 can be reversibly deactivated, is particularly clearly apparent from FIGS. 12, 21, 29, 34 and 38 and the description thereof).

The fact that this involves a retraction device for a moveable furniture part can be seen from FIGS. 2, 19, 23, 33, 35 and 37 and the description thereof.

The fact that the deactivation device 1 is adapted to be switchable over between two mechanical switching positions 2 and 3, wherein a first switching position 2 activates the drive device 10 and a second switching position 3 deactivates the drive device 10 can preferably be seen from FIGS. 10, 12, 16, 17, 20, 26, 28, 32, 37 and 38 and the description thereof.

Figure 38:
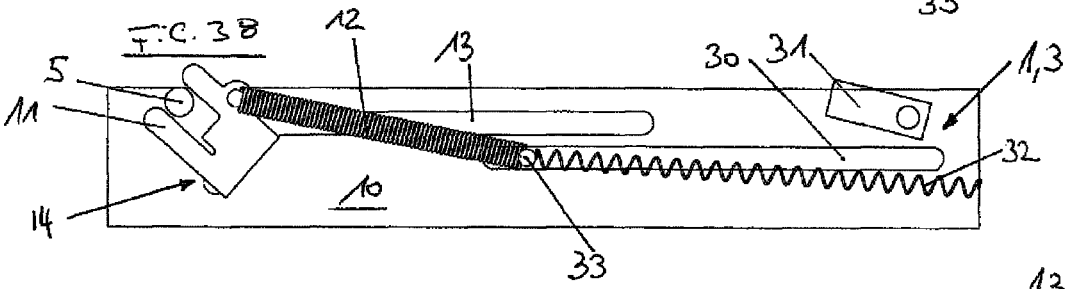
Figure 39:
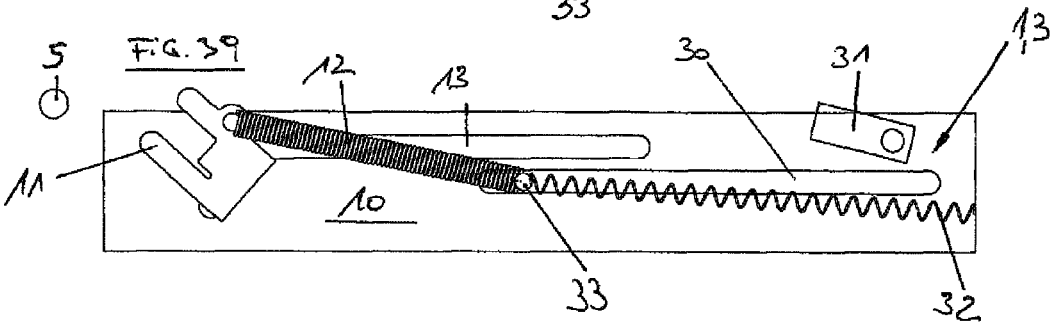

The fact that in that case switching over between those two mechanical switching positions 2 and 3 can be effected manually can be seen from FIGS. 27, 33 and 38 and the description thereof.

The fact that such mechanical switching-over can also be effected automatically, involving switching from the first switching position 2 in which the drive device 10 is activated into the second switching position 3 in which the drive device 10 is deactivated can be seen from FIGS. 12 and 19 and the description thereof.

The fact that in that respect the mechanical deactivation device 1 is provided in the drive device 10 itself can be seen from FIGS. 10, 16, 27, 32 and 37 and the description thereof.

The fact that automatic mechanical switching-over between the two switching positions 2 and 3 is effected by a—subsequently fitted—second drive device 20 can be seen from FIGS. 19 and 9 and the description thereof.

The fact that the mechanical deactivation device 1 can also be provided in the second drive device 20 and engages into the first drive device 10 can be seen from FIG. 19 and the description thereof.

The fact that automatic mechanical switching-over is effected by the second drive device 20 during the movement of the moveable furniture part 100—preferably the drawer 102—can be seen from FIGS. 2 through 18 and the description thereof. The fact that in that respect that automatic switching-over is effected in the first-time movement of the moveable furniture part 101 can also be seen from those Figures and also the fact that such automatic switching-over is effected exclusively in the first-time movement of the moveable furniture part 101.

The situation is such in all these embodiments that the drive device 10 is of a purely mechanical design, that is to say without electric power.

The invention claimed is:

1. A spring-loaded drive device for a movable furniture part, wherein there is provided a mechanical deactivation device with which the spring-loaded drive device can be reversibly deactivated, and wherein automatic mechanical switching-over between two switching positions is effected by a second drive device that is subsequently fitted.

2. A spring-loaded drive device as set forth in claim 1, wherein the spring-loaded drive device is a retraction device for the movable furniture part.

3. A spring-loaded drive device as set forth in claim 1, wherein the spring-loaded drive device is an ejection device for the movable furniture part.

4. A spring-loaded drive device as set forth in claim 1, wherein the spring-loaded drive device is of a purely mechanical configuration, without electric current.

5. A spring-loaded drive device as set forth in claim 1, wherein a first one of the two switching positions activates the spring-loaded drive device and a second one of the two switching positions deactivates the spring-loaded drive device.

6. A spring-loaded drive device as set forth in claim 5, wherein the mechanical switching-over is effected automatically from the first one of the two switching positions in which the spring-loaded drive device is activated into the second one of the two switching positions in which the spring-loaded drive device is deactivated.

7. A spring-loaded drive device as set forth in claim 1, wherein the mechanical deactivation device is embodied in the spring-loaded drive device.

8. An article of furniture having a spring-loaded drive device for a movable furniture part as set forth in claim 1.

9. An article of furniture as set forth in claim 1, wherein the mechanical deactivation device is embodied in the second drive device and engages into the spring-loaded drive device.

10. An article of furniture as set forth in claim 1, wherein the automatic mechanical switching-over is effected by the second drive device during a movement of the movable furniture part.

11. An article of furniture as set forth in claim 10, wherein the automatic mechanical switching-over is effected by the second drive device during the movement of the movable furniture part for the first time after installation of the second drive device has been effected.

12. An article of furniture as set forth in claim 10, wherein the automatic mechanical switching-over is effected by the second drive device exclusively during the movement of the movable furniture part for the first time after installation of the second drive device has been effected.

13. An article of furniture as set forth in claim 1, wherein the movable furniture part is a drawer.

14. A drive device for a movable furniture part, wherein there is provided a deactivation device with which the drive device can be reversibly deactivated, wherein the drive device comprises an entrainment member, which is couplable to a coupling element, wherein the deactivation device comprises a nose, and wherein the coupling element is movable by a rail extension guide via the nose from a first switching position to a second switching position, in which the drive device is deactivated such that the entrainment member is not couplable with the coupling element in a state in which the rail extension guide is moving.

15. An article of furniture as set forth in claim 14, wherein the movable furniture part is a drawer.

16. A drive device for a movable furniture part, wherein there is provided a deactivation device with which the drive device can be reversibly deactivated, wherein an entrainment element is movable in a guide track, wherein the guide track comprises a readiness position, in which the entrainment member is self-lockingly arrestable, wherein a part of the guide track comprising the readiness position is arranged in a guide plate, which is rotatably coupled with the drive device, and wherein the guide plate is rotatably movable from a first switching position to a second switching position, in which the part of the guide track, which comprises the readiness position, is out of contact with a remainder of the guide track arranged on the drive device.

17. An article of furniture as set forth in claim 16, wherein the movable furniture part is a drawer.

18. A drive device for a movable furniture part, wherein there is provided a deactivation device with which the drive device can be reversibly deactivated, wherein the drive device comprises an entrainment member, the entrainment member comprising a pivotable entrainment nose, wherein, in a first switching position, a coupling element is arranged between the pivotable entrainment nose and another part of the entrainment member, wherein, in the first switching position, the coupling element is movable by the entrainment member, and wherein the pivotable entrainment nose can be tilted out of a normal working position thereof, which corresponds with the first switching position, such that the deactivation device is in a second switching position and the coupling element is not movable by the entrainment member.

19. An article of furniture as set forth in claim 18, wherein the movable furniture part is a drawer.

20. A drive device for a movable furniture part, wherein there is provided a mechanical deactivation device with which the drive device can be reversibly deactivated, wherein the drive device comprises a guide track having a readiness position for an entrainment member, wherein the entrainment member is couplable with a coupling element, wherein the entrainment member is loaded by a spring, wherein a first end of the spring is connected to the entrainment member and a second end of the spring is connected to a base, wherein the base is movable in a guide of the drive device, wherein a lock element is configured to prevent a movement of the base in the guide in a state in which the lock element is in a first switching position, the lock element forming the deactivation device, and wherein the base is movable in the guide in a state in which the lock element is in a second switching position.

* * * * *